US008419140B2

(12) United States Patent
Ward

(10) Patent No.: US 8,419,140 B2
(45) Date of Patent: Apr. 16, 2013

(54) CHAMBERED CREMATION URN MEMORIAL WITH ATTACHED OR INTEGRATED ELECTRONIC IMAGING DEVICE

(75) Inventor: John William Ward, Palmetto, FL (US)

(73) Assignee: John William Ward, Palmetto, FL (US)

( * ) Notice: Subject to any disclaimer, the term of this patent is extended or adjusted under 35 U.S.C. 154(b) by 827 days.

(21) Appl. No.: 12/589,759

(22) Filed: Oct. 28, 2009

(65) Prior Publication Data

US 2010/0102685 A1 Apr. 29, 2010

Related U.S. Application Data

(60) Provisional application No. 61/197,551, filed on Oct. 28, 2008.

(51) Int. Cl.
*A47B 81/06* (2006.01)
*A47G 29/00* (2006.01)

(52) U.S. Cl.
USPC ..... 312/7.2; 312/223.5; 27/1; 211/85.27

(58) Field of Classification Search ..... 312/7.2, 312/117, 204, 223.5, 223.1, 223.3, 234, 234.3; 27/1; 211/1, 85.16, 85.27; 108/23
See application file for complete search history.

(56) References Cited

U.S. PATENT DOCUMENTS

| | | | | |
|---|---|---|---|---|
| 707,325 | A * | 8/1902 | Hicks | 312/333 |
| 1,382,704 | A * | 6/1921 | Wolf | 312/117 |
| 1,601,377 | A * | 9/1926 | Sherer | 312/117 |
| 3,672,741 | A * | 6/1972 | Clark | 312/7.2 |
| 3,961,456 | A * | 6/1976 | Manlove et al. | 52/717.03 |
| 4,073,100 | A | 2/1978 | DiGiovanni et al. | |
| 4,920,458 | A * | 4/1990 | Jones | 362/33 |
| 5,794,318 | A | 8/1998 | Parker et al. | |
| 5,896,632 | A | 4/1999 | Sturino | |
| 6,042,203 | A * | 3/2000 | Bogucki | 312/223.3 |
| 6,283,608 | B1 * | 9/2001 | Straat | 362/133 |
| 6,414,663 | B1 | 7/2002 | Manross et al. | |
| 6,735,831 | B1 | 5/2004 | Greiwe et al. | |
| 6,854,165 | B1 | 2/2005 | Parker | |
| D509,638 | S | 9/2005 | Moritz et al. | |
| 7,089,495 | B2 | 8/2006 | Barrows | |
| 7,367,685 | B2 * | 5/2008 | Moll | 362/133 |
| 7,665,860 | B2 * | 2/2010 | Demarest et al. | 362/125 |
| 2003/0091784 | A1 * | 5/2003 | Nykamp et al. | 428/99 |

(Continued)

FOREIGN PATENT DOCUMENTS

EP 102582 A1 * 3/1984

*Primary Examiner* — Darnell Jayne
*Assistant Examiner* — Stanton L Krycinski

(57) ABSTRACT

A lighted decorative cremation urn memorial constructed of rigid interlocking paneled materials used to house and display cremation urns and the personal effects of the decedent. A multi-chambered design allows for chamber areas to be aesthetically enhanced with the addition of cut stone and fabric inserts while outfitting other chambers with electronic imaging capability such as a liquid crystal display (LCD) picture screen with integrated functions and remote control. A user can utilize chamber areas to simultaneously display cremation urn(s), personal effects, and present electronic media. Certain chambers contain lighting systems, such as light emitting diode (LED) or other, where cremation urns and personal effects can be better accentuated. Added personalization includes the ability to engrave surfaces and affix engraved panels or emblems to suit the user. Thus the family or loved ones of a decedent may be provided with multiple options.

7 Claims, 3 Drawing Sheets

U.S. PATENT DOCUMENTS

2005/0097912 A1* 5/2005 Nam et al. ..... 62/331
2006/0197418 A1* 9/2006 Kelly ..... 312/223.5
2007/0170823 A1* 7/2007 Stannis et al. ..... 312/7.2
2007/0236113 A1* 10/2007 McCambridge et al. ..... 312/204
2008/0047186 A1 2/2008 Strickland
2008/0169734 A1* 7/2008 Bartels ..... 312/7.2
2008/0315734 A1* 12/2008 Birsel et al. ..... 312/223.3

* cited by examiner

CHAMBERED CREMATION URN MEMORIAL WITH ATTACHED OR INTEGRATED ELECTRONIC IMAGING DEVICE

CROSS-REFERENCE TO RELATED APPLICATIONS

This application claims the benefit of provisional patent application Ser. No. 61/197,551 filed 2008 Oct. 28 by the present inventor.

FEDERALLY SPONSORED RESEARCH

Not Applicable

SEQUENCE LISTING OR PROGRAM

Not Applicable

BACKGROUND

1. Field

This application relates generally to memorial products, mausoleums, or tombs for the deceased used to store, display, and illuminate single or multiple cremation urns containing the cremated ashes of a corpse (human or animal), with particular ability to introduce pictures, sounds, and/or video via an attached or integrated electronic imaging device.

2. Prior Art

Throughout recorded history peoples of all cultures have honored their deceased in various ways surrounding the actual time of death and thereafter. Many factors such as societal values, religious practices, and personal preferences play roles in how matters following a death are handled. As some religions and cultures practice what may be considered "traditional" rituals involving burial of the dead, others are more open to alternatives to these practices that may manifest in a variety of ever-evolving options. Perhaps the most common alternative to burial is that of cremation. This is where the corpse of a human or animal is burned using significant heat sources (fire or other) subsequently reducing that corpse to carbon based ash and small burnt fragments. Those that have chosen this option for the deceased have choices as to what to do with the cremains (cremated remains of a human or animal). In some cases, cremains are simply distributed in designated areas such as a memorable place where they become integrated into the natural environment. In other cases, cremains can be buried, made into objects such as jewelry, or a number of newly available and/or trendy options. The seemingly most common handling of cremains still comes in the form of placing them into a container, also known as a cremation urn, and placing the urn in a particular location. For these purposes, all further references to cremation urns will infer those cremation urns containing the cremains of a deceased human or animal. Some associates to the deceased (friends or family) may choose to place and house the cremation urn in a mausoleum or columbarium setting that is usually located on or near a standard graveyard. This option encompasses the placement of a cremation urn in a locked vault or tomb either above or below ground, where there usually exists a memorial plaque of some type providing information on the deceased. U.S. Pat. No. 4,073,100 to DiGiovanni Jr. (1978) shows an example of a mausoleum structure design to be used for the purposes described above while incorporating possible improvements to those designs before it. Where the storage of cremation urns within a mausoleum may be common, the practice of bringing and storing cremation urns to personal residences or homes is common as well.

Many people choose to bring cremation urns home to be displayed or stored. This can likely be attributed to a strong sense of personal connection with the deceased and/or objects associated thereto. Practices such as placing the cremation urn or the cremains in a designated place within or outside a home for display or remembrance purposes are common. Those choosing to display cremation urns in such ways and for such purposes may do so at their discretion, and are only limited to personal ideas, beliefs, and their own creativity in such matters. In recent years, the funeral industry and private inventors have introduced many innovative urn-related inventions designed to assist in remembrance processes. U.S. Pat. No. 5,795,318 to Parker et al. (1998) shows an example of such an invention where an ornamental lawn/garden fountain was integrated with an area to house cremated remains. Another example by Parker et al, U.S. Pat. No. 6,112,382 (2000), shows configurations where a container to house cremains is integrated with wind chimes or in a pedestal setup with an accompanying sundial. Such examples illustrate some of the previous designs that integrate cremains in decorative items for outside home display. The utilization of such devices is becoming more common as industry trends continue to migrate toward cremation.

For those who wish to display cremains inside the home, other designs exist. Devices that serve purposes of both housing cremains and being themed in nature are quickly emerging as alternatives to the more standard styled urns. For these purposes, the reference to standard styled cremation urns are those containers specifically designed to house cremains that are generally non-themed, decorative in nature, and can be made of metal(s), wood, or other materials. Other more elaborate urn styles have emerged in the recent years. Take the design by Moritz, U.S. Pat. D509638 (2005), where an urn takes the shape of a motorcycle gas tank. Such a design may be appropriate for housing the cremains of a decedent who was strongly associated with and/or was an enthusiast of motorcycles. Sturino shows an even more advanced device, U.S. Pat. No. 5,896,632 (1999), whereas a cremation urn takes the shape of a football helmet with an integrated picture frame with a base or stand. Another example brings additional features, U.S. Pat. No. 6,735,831 to Greiwe et al. (2004) shows an invention that is designed to house a decedent's cremains and display personal mementos. Through the usage of a transparent shadow-box type top, a retractable memorial plate, and an area for cremains to be contained within, Greiwe et al. shows an invention tailored toward a user who wishes to keep both cremains and associated personal mementos together within one memorial. The above examples show inventions designed to assist a user in the personal and decorative display of cremains. Urns in many shapes continue to become available, and memorials such as the one illustrated by Greiwe et al, continue to evolve and are influenced by newer technologies. A more exclusive design involving an urn with integrated digital picture screen urn was recently seen on multiple technology websites. This design involves an urn to house the cremains of a pet and has an integrated digital picture screen on which to display pictures of that pet. This device is rather plain in comparison to a similar available device where the idea was taken further by improving the overall aesthetic appearance. The device incorporates aesthetic improvements such as nickel accents and polished granite materials. These devices may possibly be the most technologically advanced urns available and are now available for purchase. Although these devices may be placed in multiple settings, it appears that they remain only urns themselves, regardless of their electronic features. This limits the user to only placing the cremains within and displaying electronic pictures.

In referencing newer technologies within the scope of funeral related products and beyond, several inventions are notable. U.S. Pat. No. 6,414,663 to Manross, Jr. (2002) shows several embodiments depicting its title of "Self-Contained Electronic Memorial". Within the scope of this invention, Manross incorporates an electronic viewer and associated electronics, namely a liquid crystal display (LCD) screen, into various embodiments. He shows how such an incorporation of newer technology such as the aforementioned may help to tell a deceased person's life story to onlookers. The embodiments he references show that this can be done with a grave marker to an urn where it can be incorporated. Manross focuses heavily on the durability of his invention, as its primary function may be to withstand time and a multitude of natural elements while still maintaining its ability to function and tell the life story of a decedent. Since Manross introduced his invention, technology has continued to evolve. LCD devices have become readily available and less expensive with many integrated functions similar to the electronic urns referenced above and those he illustrates. U.S. Pat. No. 7,089,495 to Barrows (2006) shows an invention similar to one embodiment from Manross in that an electronic or similar picture screen can be placed into a grave marker for similar purposes. Barrows shows a grave marker with unique abilities to include: electronic imagining, mounted speaker system, and utility accessibility. Perhaps the devices shown above and similar type items may eventually prove to revolutionize a more typical graveyard or burial site where only static monuments currently exist.

Other designs not related to funeral care or cremation has encompassed newer technologies as well. U.S. Pat. No. 0,047,186 A1 to Strickland (2008) shows such a design of a sports memorabilia oriented display case that encompasses video and sound technologies to accentuate the relating sports memorabilia being displayed. This idea is ingenious in that the introduction of the media playing device adds to the capabilities of generalized designs before it. However, Strickland limits his scope of design to displaying memorabilia (and accompanied related media) under its inclusive definition. Although this may encompass a large variety of items on many levels, it does not include for containers containing the cremated ashes (or similar type remains) of corpses, which are not defined as "memorabilia". It appears that the aforementioned design was meant primarily for sports related items and related media with the capability of other more general display uses. It does not appear that this invention was in any way intended for such use as a cremation oriented display to honor and remember the deceased.

All devices referenced within the scope of this context and subsequently known to exist suffer from distinct disadvantages relating to a user who has needs for a device encompassing the following capabilities:

(a) Ability to house and/or display single or multiple cremation urns (traditional or themed) inside a home or business within a suitable structure, and;

(b) Contain, display, and/or house such cremation urn(s) in a fashion as to decoratively and tastefully remember a decedent by providing space for the decedent's personal affects within the device itself, and;

(c) Incorporate modern illumination and imaging technology by attaching and/or integrating such technology within the device whereas the aforementioned serves to accentuate its contents, and;

(d) Contains attached or integrated electronic imaging device or devices to display electronic pictures, video (with or without sound), and/or an electronic timepiece(s), and;

(e) Has areas upon or within to attach single or multiple static memorial plates or plaques containing writings, engravings, and/or emblems providing either information on a decedent, prayers or sayings, or a combination thereof.

The prior art and other devices may suggest creative renditions of the cremation urn container itself and subsequently other related memorial products with other features. Disadvantages of the referenced prior art and any other known device cannot adequately provide for the device capabilities referenced above. If a user wishes to display a cremation urn (or urns) with or without a decedent's personal affects, and that user wishes to place, house, and/or display that urn within a device with the above referenced attributes, that user would presently have no known option.

SUMMARY

In accordance with one embodiment of the Chambered Cremation Urn Memorial with Attached or Integrated Electronic Imaging Device, the device itself is comprised of wood panels that interlock together to form a three chambered memorial. This embodiment consists of a rectangular base and top of similar dimension held apart by the introduction of a backing panel and side panels of equal height forming a cube-like structure. The said side and backing panels may interlock with the top and base via a plurality of cut groves so that they fit slightly inside the top and base. Elongated support members of similar height to the side and backing panels may be placed and integrated to the top, base, and side panels at the corners of the structure for additional support or for aesthetic value. Within the structure two additional walls may be added that abut the base, top, and backing panel in the same fashion so that the structure itself has three open chambers from the front view. Lighting systems that illuminate chambers, such as light emitting diode technology (LED) or other may be integrated into the base or top by affixing such lighting in a desired location onto or into the aforementioned areas. The individual chambers of the device consisting of three wall areas and one bottom area may be covered with other material such as stone tiles and other rigid panels covered with fabric type material. Such coverings would be thin enough as to be minimally intrusive to the actual volume of the chamber size so that adequate size remains for placement of one or more cremation urns containing the cremated remains of humans or animals within the chamber(s). One of the chamber openings may be covered by adding a hinged door of rigid material affixed to the front (open side) edge of either an exterior or interior wall via screws or other, whereas the door has an area removed from it so that an electronic imaging device such an liquid crystal display, digital picture screen, or electronic timepiece can be inserted into the door. The side of the electronic device meant to be viewed may be seen while the door is in the closed position, and the said door would have a stop or catch of some type so that it would close at a desired position. The remaining area outside of the door below the viewable area of the electronic device may have a plaque of some type affixed to it. Such a plaque may contain writing in the form of engraving or other, and such a plaque may contain information relating to the decedent whose cremated remains are housed within the chambers of the device. Any electronic devices requiring electricity to operate may derive their power by a power cord or other threaded through an adequately sized hole constructed in either the base or the backing panel, and such a hole may be placed in the chamber on which door containing the electronic imaging device is located as to hide the cord from plain view. The addition of a rigid wall mounted directly behind the door may also be desired and added as to abut the top, base, and side walls of chamber to more efficiently hide a power cord or any other electronics from view by placing such electronics or cord behind such a wall toward the rear or backing panel of the device. Added decorative furniture type feet may also be added to the device in its completed form by affixing such feet to the base of the device below the chambered areas in all four corners. Such an addition may prove to add aesthetics and support to the completed device overall.

DRAWINGS-Figures

DRAWINGS-Reference Numerals

Figure 1:
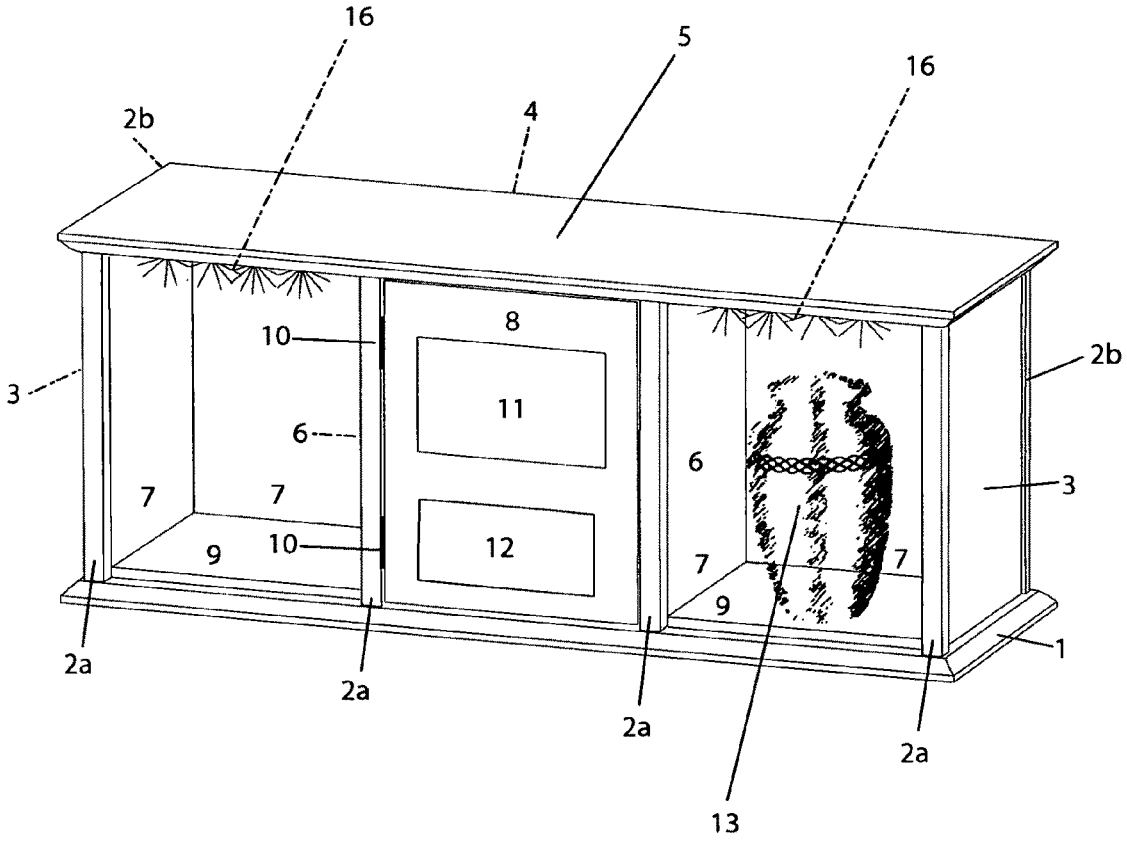
FIG. 1 shows a forward facing cremation urn memorial in its completed form with open chambers to each side of door containing the electronic imaging device as described in the "summary" section above.

1 flat base
2*a* elongated support member (front)
2*b* elongated support member (rear)
3 side wall
4 backing panel
5 flat top
6 interior separating wall
7 interior wall inserts of rigid material covered with fabric
8 chamber door with cutout to house and support electronic imaging device
9 cut stone inserts
10 door hinges
11 electronic imaging device/liquid crystal display (LCD) picture screen
12 plaque with writing or engraving
13 cremation urn
14 false wall
15 hole for power supply
16 thin light emitting diode (LED) strips
17 recessed groves in flat top to inset lighting
18 illumination power wires
19 electronic convergence area
20 alternating current (AC) to direct current (DC) transformer
21 power supply cord
22 electronic imaging device (EID) power supply
23 door catch

DETAILED DESCRIPTION (SPECIFICATION)

Figure 2:
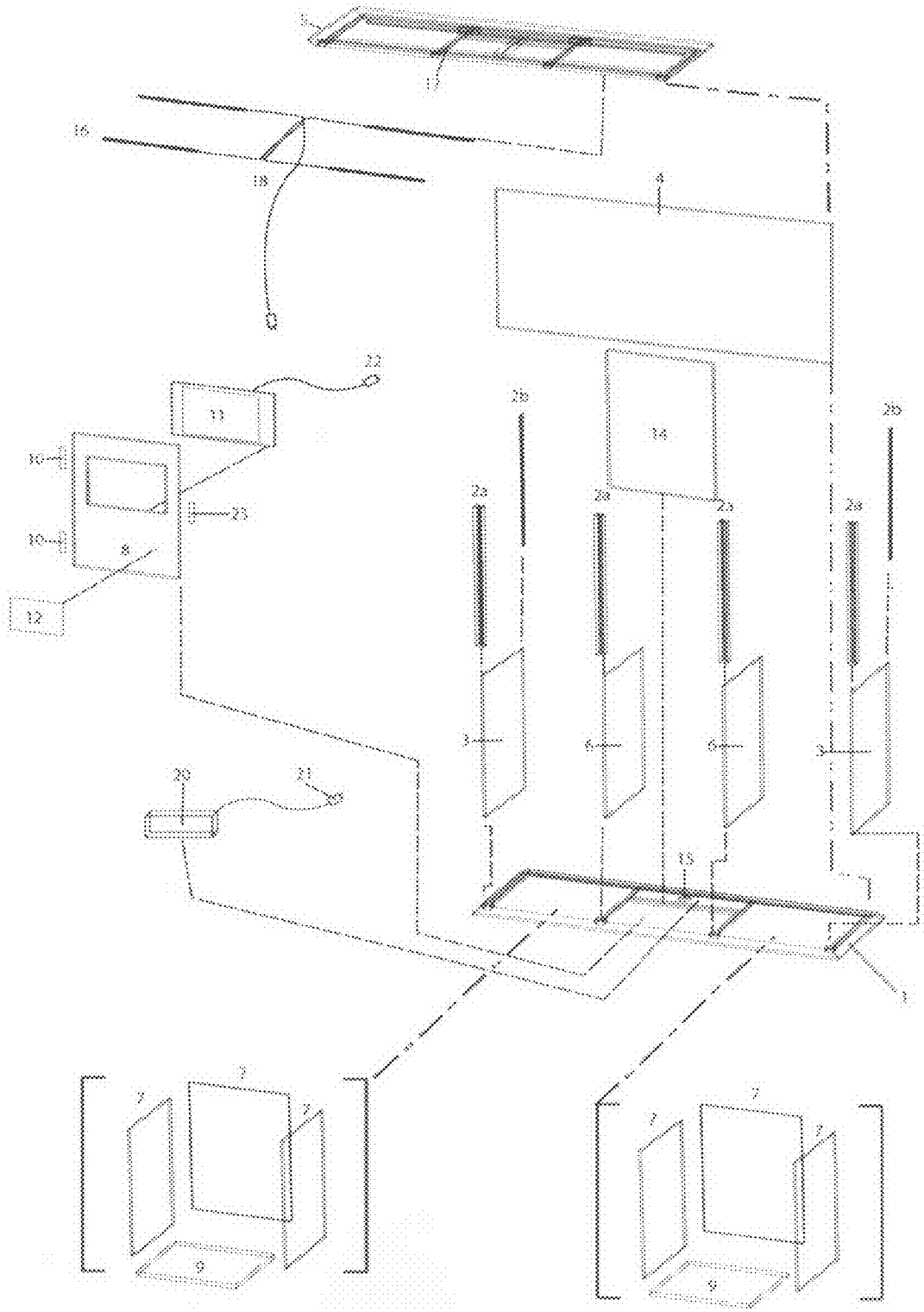
FIG. 2 shows the same embodiment in an exploded view, also forward facing, whereas the individual parts of the embodiment are shown how they come together and create the embodiment as a whole.
Figure 3:
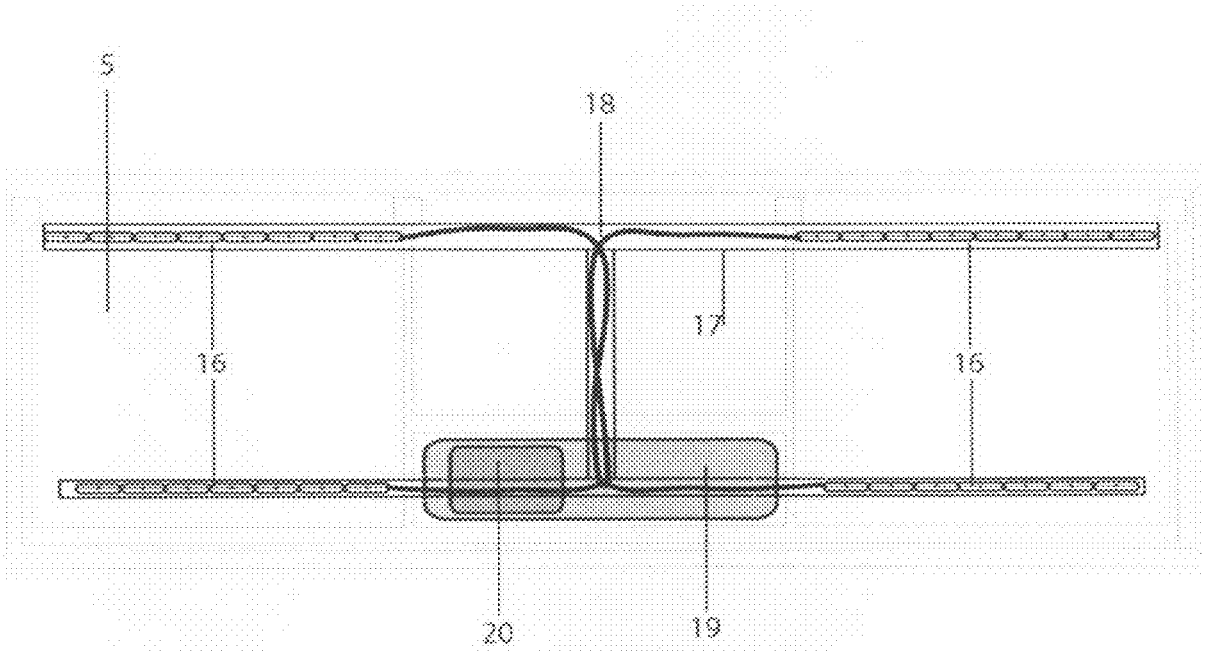
FIG. 3 shows the underside of the flat top from the above embodiment where the lighting system, associated wiring, recessed grooves (in flat top to inset lighting) can also be seen.

FIGS. 1 through 3 show perspective views of one version of the Chambered Cremation Urn Memorial with Attached or Integrated Electronic Imaging Device. Within this embodiment and in FIG. 1, the device is shown in its completed form and shown as forward facing. The flat base #1 and flat top #5 are connected by four elongated support members (front) #2*a* and are connected to device flat base #1 at equally spaced lengths and at right angles along the forward facing edge of flat base #1. Two additional elongated support members (rear) #2*b* are shown and indicated to be connected at the rear outside corners of flat base #1 and flat top #5 in a similar manner thus spacing the flat top and base apart from one another. Two side walls #3 are connected to the flat base #1, flat top #5, and elongated support members #2*a* and #2*b*, and are located at the far right and left sides of the device respectively. The backing panel #4 is connected to the flat base #1, flat top #5, and both elongated support members #2*b*. Two interior separating walls #6 are shown to be connected to the two inner elongated support members #2*a*, flat base #1, and flat top #5, and backing panel #4, thus creating three inner chambers within the device with open areas shown as the device is forward facing. Chamber door with cutout opening to house or support electronic imaging device #8 is located at the forward facing middle chamber enclosing that chamber. Door #8 is shown in the closed position with door catch #23 inhibiting door #8 from further inward movement and holding door #8 in the closed position. The aforementioned door #8 is connected to one of the elongated support members #2*a* via two hinges #10 with screws or other hardware, and is shown with a rectangular cutout toward the door top. The rectangular cutout allows for placement of an electronic imaging device #11, for these purposes a liquid crystal display (LCD) picture screen (multiple functions integrated inclusive of remote control), to be abutted and attached to the rear of the door whereas the LCD picture screen or imaging device #11 would be forward facing as to be able to view electronic pictures or videos while the door #8 is in its closed position obscuring the chamber opening within. Due to the rectangular cutout of door #8 being in the upper half of the door, plaque with writing or engraving #12 may be placed or affixed to the lower half of door #8 so that the plaque #12 may also be viewed while door #8 is in the closed position. Within FIG. 1, it is shown where two open chambers exist to each side of door #8 whereas interior wall inserts of rigid material covered with fabric #7 are affixed to the three interior wall areas within each chamber. It is subsequently shown that the base area of the chambers have cut stone inserts #9 placed on the bottom or floor area of the chambers. It is these chambers where cremation urns #13 can be placed.

FIG. 2 shows an exploded view of the first embodiment of the Chambered Cremation Urn Memorial with Attached or Integrated Electronic Imaging Device. Within this drawing and examining the drawing detail of flat base #1, elongated support members #2*a* and 2*b*, and flat top #5, it can be seen that all the aforementioned parts contain a series of cut notches or groves in which parts such as side walls #3, backing panel #4, and interior separating walls #6 fit into notches or groves during device assembly whereas to add aesthetic quality and strength to this embodiment. Respectively, elongated support members #2*a* and #2*b* also fit into top and base in a similar fashion and for the same purpose. It can also be seen in FIG. 2 that the introduction of a false wall #14 placed behind door #8 and connected with similar grooves or notches as previously noted, is used to create space hidden from view behind door #8 and may be noted as the electronic convergence area #19 as seen in FIG. 3. The purpose of false wall #14 is for hiding an introduced main power supply cord #21, illumination power wires #18, and imaging device power supply #22 within the area it creates between false wall #14 and backing panel #4 when the device is in its completed form. The power supply cord #21 is introduced through a hole #15 cut in the flat base #1 behind false wall #14. FIG. 2 also shows the electronic imaging device #11 with attached electronic imaging device (EID) power supply #22. The main power supply cord #21 is shown separate from the base in FIG. 2. The interior wall inserts #7 and the cut stone inserts #9 are shown grouped in brackets in FIG. 2, and indicated so that the group is introduced into the two open chambers respectively.

FIG. 3 shows the underside of the flat top #5 whereas recessed groves #17 have been integrated for the placement of thin light emitting diode (LED) strips #16 and any associated illumination power wires #18 attached and inset in grooves #17. The recessed grooves serve to obscure the thin LED strips #16 from plain view while still allowing the strips to provide light from both the front and rear underside of the flat top #5 so that the chambers to the left and right of the door #8 are illuminated from above. The convergence area #19 in FIG. 3 would be the area behind false wall #14 from FIG. 2 where a main power supply cord #21 is integrated through hole #15 and illumination power wires #18 hidden from view and connected to a alternating current (AC) to direct current (DC) transformer #20. Electrical power would be introduced to any component requiring such and hidden from plain view in the convergence area #19.

The abilities of the embodiment shown in FIGS. 1 through 3 shows a device having attached and integrated features allowing a user to display and illuminate single or multiple cremation urns while showing electronic pictures or video associated to the decedent or otherwise. Such abilities of the device allow a user to honor a decedent by having a designated place to house and display the decedent's cremation urn and personal effects within one device. The device shown in this embodiment also has many options for personalization inclusive of material(s), color(s), and size which can all be changed according to what a user's personal preferences may be. Such abilities would likely serve to ease the usually painful human emotions that frequently occur before, during, and after the grieving process surrounding a death. The problem of where to house, store, or display cremation urns plagues many grieving families and individuals and may continue to do so until options shown in this embodiment become widely available. Such unique device abilities are not known to exist and have not been seen in the prior art.

Operation:

Where much of the embodiment shown in FIGS. 1 through 3 consists of static rigid parts and materials that attach and/or interconnect, several referenced parts do have unique and notable abilities. The thin light emitting diode (LED) strips #16, for example, have characteristics that continue to revolutionize modern illumination. Among these characteristics, LED lighting and referenced LED strips #16 use very little electricity and produce very little heat which is generally derived by converting alternating current (AC) to direct current (DC) via a small transformer of some type #20. Depending on the voltage amount provided to such light strips #16 (such a lighting system does have operating and functional parameters in this area), the said LED strips #16 can be made to emit more or less light. Whereas the referenced embodiment refers to the LED strips #16 simply deriving power through the referenced illumination power wires #18 that would be connected to an AC/DC transformer #20 (of appropriate characteristics) via an introduced extension cord or similar through hole #15 causing simple illumination, such a configuration has many more options. Additions of switches that could be easily be mounted to false wall #14, or other devices such as a dimmer apparatus suited for these purposes may also be utilized. Such LED strips #16 come in a wide variety of color configurations that in some case include the ability to change color or display patterns. Other shapes and sizes of LED lighting configurations also exist and could be substituted for LED strips #16.

Perhaps the most notable part of the overall device is the electronic imaging device #11, whereas such an imaging device is that of a modern LCD picture screen. In referring to a modern LCD picture screen, it can be noted that such a device can be as simple as a monitor type device that can only display electronic images after being connected to another device with the capabilities to store and play electronic media. For these purposes and in this embodiment, the electronic imaging device refers to the widely available type having the ability to display pictures, videos, and sounds while having the additional capabilities to store digital media within the device and accept portable storage sources such as media storage cards (multiple varieties). It is common for these devices to have the capabilities to display electronic pictures, videos, and sounds in whatever order the user programs the device to do so depending on the capability of the device itself. Devices such as this usually have power cords, integrated or detachable, that accompany the device as purchased or packaged. The compact nature and features of such a device would make it suited for usage within the aforementioned embodiment.

Overall operation of the embodiment shown in FIGS. 1 through 3 would consist of the following:

1. The user would place single or multiple cremation urns #13 into one or both chamber openings located to either side of door #8 shown in FIG. 1. The user may choose to place a decedent's personal effects in those chamber openings alone or in combination with the aforementioned cremation urn #13.
2. The user would subsequently plug power supply cord #21 into an electrical outlet (of proper specification) exiting from the hole #15, shown in FIG. 2. Inside electronic convergence area #19, AC/DC transformer #20 and electronic imaging device (EID) power supply #22 are connected to said power supply cord #21 thus providing adequate and necessary electrical power for said electrical components to properly operate.
3. The user would then open door #8 and gain access to rear or side of electronic imaging device (LCD picture screen) #11 where said device #11 would be activated via an on/off switch or button. The user could then control device #11 with operating controls directly on device #11 or with an associated remote control (most such available devices have this option). Media storage cards containing electronic pictures, video, and/or sound may now be introduced and the media subsequently displayed on device #11. Door #8 may then be moved to the closed position whereas the door fully occupies the chamber opening and is flush with the structure face after being stopped by catch #23 allowing for clear viewing of LCD picture screen #11.

Within the overall embodiment of FIGS. 1 through 3 and after the above operations are complete, the user may step away from device while the cremation urn(s) #13 are illuminated by LED strips #16, and the electronic imaging device #11 displays whatever electronic media however the user prefers. The embodiment then serves as a memorial to the decedent allowing for dynamic electronic image display(s) and possibly sounds if device #11 is so equipped.

DESCRIPTION AND OPERATION OF ALTERNATIVE EMBODIMENTS

The embodiment shown generally in FIGS. 1-3 features a chambered design that can be assembled in either a horizontal or vertical fashion. This embodiment would be typically designed in a two (2) or three (3) chambered style in which one of the chambers would feature a door to house an imaging device of some type, preferably an LCD or other digital picture frame with the following features: integrated media storage and/or ability to read external media sources such as media storage cards, flash drives, or be coupled directly to a computer via a USB (universal serial bus), and derive information to be displayed with or without sound. All chambers in this embodiment would typically be built to specifications to house a standard sized cremation urn or other. The display itself would primarily be made from solid hardwood of some type (inclusive of a top, base, and back) with some wood paneling for interior/exterior walls (inclusive of a false wall if equipped). The wood panels would be held in place via precise cuts in the top, base and back of the primary pieces, allowing those panels to fit together like a puzzle. Across the front of the unit vertically and at the end of each wall panel, would be elongated support members of hardwood where the wall panel ends would adjoin to the support members. The support members would also have cuts or grooves in them allowing the panels to fit securely within, thus making finished edges and providing additional structure of the cremation urn memorial. The elongated support members would also be cut or notched on each end as to fit securely into the top and base of the memorial as well. Hardwood or MDF (medium density fiber board) board would be used for the chamber door with cutout opening to house or support electronic imaging device (FIGS. 1-2), and this material would be cut or notched so that the LCD or other digital picture frame would fit securely into and against it. The door would be hinged as to allow the user to open the door and have access to the functionality region of the LCD or other picture screen. The door hinges of any suitable type would be affixed to an elongated support member or the end of one interior separating wall and subsequently the door. Doors could be framed with additional wood for aesthetics, and would be adorned with an engraved, printed, or etched plate (typically made of thin metal or acrylic) to reveal information as to who or what the display memorialized. For these purposes, actual engravings in the wood could take the place of affixing a plaque to the door (FIGS. 1-2). In the case of a three chambered memorial, the additional chamber could be used for additional cremation urns and/or the display of personal effects via placing such personal effects in the chamber with or without the use of a stand of some type to elevate such effects. The usage of some type of integrated lighting within this embodiment, such as LED strips (FIGS. 1-3) would be aesthetically pleasing and useful in such a memorial in that the cremation urn(s) and/or personal effects could be illuminated as to be better accentuated to those looking into such a memorial. The use of LED lighting (generally) or LED strips would be most preferred due to the extreme versatility in terms of size and shape (and color), low heat signature, and long length of diode (bulb) life. For the described embodiment (FIGS. 1-3), the usage of LED strips or (ribbon) lighting would be most preferred in that such lighting could be inset at the top, sides, or base of the chamber(s) to be illuminated via small recessed grooves or tracks in which to set the lighting. Such grooves or tracks could be made via router, CNC (computer numerically controlled) machine, or other means so necessary wires attached to such lighting (illumination power wires) could be hidden from plain view by following those recessed groves or tracks to an area behind door (FIGS. 1-2) and referenced false wall (FIG. 2) to the electronic convergence area (FIG. 3). In this electronic convergence area could be placed any electronics, wires, transformers, and/or switches in which to operate the lighting. The false wall would serve to hide the electronics from plain view if the door containing the LCD or other digital picture frame was opened. A switch to control the lighting could be mounted on the forward facing area of the false wall behind the chamber door, and/or on the front facing side of said false wall making it accessible to the user. Self contained LED lighting units, usually typical of five (5) to twenty (20) individual light diode (bulbs) integrated into one sealed unit with self-contained controller (on/off or other), could also be used by insetting such a lighting device into the chamber top, side(s), or base. Such insetting could require groves or shapes cut into the display top using a router, CNC machine, or other means. The usage of self-contained LED lighting units may not require electronics to be hidden behind false wall and door, just wires to be routed out of plan view for aesthetic purposes. Lighting systems, such as those described above, are not necessary for completion of the display, but serve to make the display more appealing to the user.

Within the embodiment (FIGS. 1-3), it would be preferable to use some type of inset walls consisting of a thin baseboard (wood for this embodiment) covered by some type of thin padding and fabric material. Such walls would be the same dimensions as the inner-chamber walls and would be placed against and affixed to the back and side walls only using glues, tapes, magnets, or other materials. Such inset walls would serve to make the open chambers appear soft and colorful while complementing the aforementioned lighting system. Inset walls in this case are not necessary for completion of the memorial, but serve to make the memorial more appealing to the user.

The interior chamber floor or bottom could simply be left alone in that the chamber floor could be left as the material the memorial is made of. More preferred is an inset floor material, whereas material is removed from the display base structure in the exact size, shape, and depth of the material to be added or inset. For these purposes, an inset floor of thin marble could be added and/or inset as floor material. Many other materials could be used for such a purpose. An inset floor in this case would also serve to be aesthetically pleasing to the user and complement the inset walls. Inset floors are not necessary for completion of the display, but serve to make the display more appealing to the user.

The open chambers (used for placement of cremation urn(s) or personal effects) described within the embodiment (FIGS. 1-2) can be enclosed from the front with any type of door in a similar fashion as door #8. For these purposes, it may be desirable for such doors to be decorative in nature (matching in color and/or texture), be mounted on hinges such as door #8, and contain some type of stop or catch so the door would stop moving at a desired position. Such doors may have glass or other transparent material so that the user would have the ability to see the contents inside the memorial chamber.

With the Chambered Cremation Urn Memorial with Attached or Integrated Electronic Imaging Device, most operations of device will remain similar or identical throughout the described alternative embodiments. Some operations may vary depending on the capabilities of the electronic imaging device and the type of device used. For example, if an electronic timepiece is used in place of and LCD picture screen, the electronic timepiece may not have the complex capabilities of the LCD picture screen therefore not requiring the user to follow step 3 as described in the "operation" section above. Such an electronic timepiece would likely require only that a user insert a portable power source such as a battery of some type, set the time, and replace the battery only when necessary. When referring to LED strips, and as indicated in the "operation" section as well, different configurations of LED strips may be used in that switches with or without dimming capabilities could intersect illumination power wires completing an electrical circuit whereas the level of illumination of such LED strips could be controlled by the user. An addition of such a switch may be desirable to the user depending on preference.

Other usage of LED strips may include mounting and/or recessing with necessary illumination power wires in different locations within open chambers. This could be done on side panels on or near the base of a chamber where a user may prefer illumination from the bottom upwards rather than the reverse shown in FIGS. 1-3. LED strips may also be mounted and/or recessed in varying patterns or shapes as well, depending on user preference. Any other illumination device may also be used in place or in conjunction with the said LED strips allowing the user to illuminate cremation urns and/or personal effects housed within illuminated chambers. Such possibilities would only be limited by physical and creative ability.

Alternative embodiment 1 would be a device that would be almost identical to the embodiment described in FIGS. 1-3; with the exception that only one interior separating wall #6 would be used instead of two. The resulting completed device would consist of only one open illuminated chamber rather than two. Within this embodiment, illumination as described above would be made to work with only one open chamber rather than two.

Operation of alternative embodiment 1 would be similar or identical to that of the embodiment described in FIGS. 1-3.

Alternative embodiment 2 may be described as containing single or multiple chambers with a pitched top similar to a roof above the said chambers replacing flat top #5 with said pitched shape. Such an embodiment would be inclusive of a pediment area above the chambers. For these purposes, the LCD or other electronic imaging device could either be mounted within a chamber door such as door #8 (as described above), or within and/or against the pediment area allowing for greater usage of the display chamber(s). Such an embodiment could be made to resemble a human housing structure or animal housing structure such as a dog house. If this were the case, it may be desirable to make the chamber opening tops rounded rather than flat as to resemble the more typical style of an expensive home or dog house.

Operation of alternative embodiment 2 would be similar to that of embodiment in FIGS. 1-3. The user would turn the lighting system on using whatever switch is supplied (or simply supply power by plugging it in), set the lighting to whatever desired brightness (if the lighting system has such capabilities), turn on the LCD or other picture screen, and insert media by whatever means via the units capabilities. The user would then place a cremation urn or urns into the display's decorative chamber. Personal effects of the decedent or other could be added as well. The overall purpose of this embodiment is for the user to create a personalized urn display to memorialize and/or honor their deceased loved ones, be it humans or animals.

Alternative embodiment 3 would be a device that would be similar to the embodiment shown in FIGS. 1-3 and in alternative embodiments 1 and 2 with the exception that such a device would be constructed as to have two or more sets of chambers that could be placed atop each other via the separation of a part similar to that of flat top or flat base thus creating sets of chambers. This embodiment could have a flat top or pitched top similar to that of alternative embodiment 2 with either a single or multiple electronic imaging devices integrated to attached doors or within the pediment area. Such an embodiment may be more beneficial for commercial usage and/or multiple urn display (family or cremation urn sales). This alternative embodiment could include cut stone inserts, interior wall inserts of rigid material covered with fabric, and lighting systems (LED or other).

Operation of alternative embodiment 3 would be similar to that of all embodiments described thus far. The user would turn the lighting system on, turn on the LCD or other picture screen, and insert media by whatever means via the units capabilities. The user would then place a cremation urn or urns into the display's decorative chamber(s). Personal effects of decedents or other could be added. The overall purpose of this embodiment would be for a user or users who require more cremation urn storage/display space.

Conclusions Ramifications And Scope

While my above description contains many specifications these should not be construed as limitations on the scope but rather an exemplification of one (or several) described embodiments thereof. Many other variations are possible. For example, many different types of materials, lighting systems, and electronic imaging devices could be used. Below are some examples.

Body of Structure: The body of structure consists of a top (flat, angled, peaked, or otherwise), sides (two or more), bottom, and back. The body of structure could be constructed of the following materials: Wood or wood variants to include: solid wood boards (varying thicknesses and types), wood paneling (with or without veneers), Particle Board, MDF board or paneling, acrylic paneling (varying thickness, color, texture, and reflective attributes), metal and metal variants to include: Sheet metal, painted metals of any type, raw metals of any type (machined, stamped, rolled), machined or raw billet aluminum with or without paint, anodizing, or other treated chemical colors or coatings, with or without engraved designs. Glass or plastic of any variant.

Inset Base Materials cut, cast, machined, forged, or manufactured to size: Inset base material refers to any material that is placed in and/or on the bottom of the body of structure or any related shelf that may exist within an embodiment. Such inset base material serve mostly decorative purposes and may be made from the following: Marble, Granite, Onyx, Masonite, Corian, or any other natural or synthetic based material shaped and sized to fit the application with any variation color, texture, thickness, or polish level to include: tile, cut slab pieces, cast, or mosaics. Vinyl to include tile or cut sheet vinyl of any color, texture, pattern, thickness, or stretched vinyl. Ceramic tile to include any variant of color, texture, thickness, finish, or mosaic. Acrylic or Glass to include any variant of thickness, color, texture, transparency, light conductivity, or reflectivity. Metal (raw or otherwise) to include any variant of alloy type with, paint, chemical treatment or coating, or engraving. Lighted paneling of any type.

Walling materials (if added to structure): Walling materials refer to those additions that may be added to the body of structure within a unit. Such walling materials would be placed up against walls, and backing of a display, and can be made to fit within such walls and/or backing by making modifications to those said structures. Walling materials generally consist of: Some type of wood, plastic, or other paneled material which may or may not be covered with fabric of any type to include but not limited to: leather, suede, synthetic suede, printed fabric, velvet, nylon, polyester, cotton-based fabric, wool, vinyl, or any other natural or synthetic fabric of material. Walls may also be constructed of acrylic or glass in any variant. Metal paneling may also be used in any form. Applied coatings such as most types of paints, epoxies, resins, may also be integrated into or onto the internal wall structure of a display case.

Lighting: Lighting in any urn memorial may be introduced via taking various light sources and placing those light sources in a desired area within the memorial. Such light sources may be affixed or integrated in any manner generally not to interfere with the item or items being displayed. This process can be accomplished by mounting lighting units with hardware such as screws, brackets, or any other means to the base, walls, or ceiling of the memorial. Generally lighting is attached to the ceiling of a chamber, and may be integrated by having areas of the ceiling recessed to accommodate lighting structures as to hide most if not all of the lighting structure from view. Lighting structures may consist of Light Emitting Diode (LED) technology whether it is a sealed unit with one or multiple light diodes (such units are available in various shapes, depths, and lengths), or strip LED lighting (available in ultra-thin ribbon type with or without integrated molded plastic or metal enclosures) available in various lengths and widths. Such LED lighting may come in a large variety of colors, intensities, and shapes as well. Additional controllers are also available for some LED lighting systems that can create special effects and/or illusions such as movement, color changes, and word formation. In respect to using LED lights for urn memorial illumination, it may be preferred in that such lighting produces very little heat and illuminates for much long than other lighting types. Some other lighting types that may be used are: standard light bulbs (tungsten or other filaments) in any size, shape, or intensity, color or coating. xenon, halogen, or other lighting not specified may also be used to illuminate the chamber areas of a memorial.

Electronic imaging device types and variants: Video screens digitally or otherwise (any technology that projects a picture, pictures, or moving picture video, sound inclusive) project images into/onto an electronic imaging screen. This process may be inclusive of the projection and/or display of a single image, multiple images, moving images, images in varying patterns or overlays, and/or any type or variation of patterned image visualization (random or otherwise to include those visualizations related to music). Such devices may also have integrated speakers, and/or sound capability. Video screens are available in a variety of technologies, sizes, colors, and have differing features depending. Such screens may be made to display media using the following technologies, but are not limited to these examples: Plasma Displays, Liquid Crystal Displays (LCD), Light Emitting Diode (LED) Displays, Digital Light Processing (DLP) Displays, Cathode-Ray Tube (CRT), or any other technology created to electronically display images. Differing picture/sound qualities may exist as well to include: standard definition, high definition, three dimensional, or other. Any type of available video electronic screen or above referenced setup can be used for the purpose of the urn memorial so long as it can be made to fit into or onto the unit. The word "video" for these purposes may not be limited to screen and screen variants alone, as it may also be inclusive of projection devices, which project images into or onto any part of the urn memorial (inclusive of holographic imaging devices that may seemingly have the capability to project images into the air). All such video imaging devices derive the information they display (images, moving video, or sound) from some type of data storage unit, and such storage may or may not be contained within the device itself. Some devices may be made to derive their information from outside sources to include but not limited to: Video Cassette Recorder (VCR) and associated video tapes, Compact Disk Players (with associated disk), Digital Versatile Disk Players (DVD) with associated media or disk, Digital Card Readers (available in multiple formats and digital media card types) with associated media cards, Flash Drives, Solid State Drives (SSD), computer based media players, Hard Disk media players, or any other digital and/or non-digital device that has the ability to supply data, media, or related material to be displayed on or through an imagining device for use in an urn memorial. Such media storage or transfer devices may or may not be housed within the memorial.

Different Display Materials: urn memorial can be used to display a vast variety of different items and materials to include but are not limited to: Personal Effects of a decedent or other inclusive of: any item or items, regardless of material (so long as the material fits into/onto the memorial or within chambers), that any particular person or persons feel worthy to display within the memorial. Cremation urns or any such container which houses, contains, or is fabricated from the cremated remains (or cremains) of a human or animal. Such cremation containers typically are decorative in nature and aesthetically pleasing to the eye, but are not necessarily so. Such containers come in a vast variety of colors, materials, and shapes, and may possibly be manufactured from the actual cremains themselves. Trophies, awards, service medals, certificates of achievement of any kind, or any type of item that recognizes a decedent or other in any way, be it positively or otherwise.

I claim:

1. A decorative device for displaying cremation urns, containers housing the cremated remains of humans or animals, and personal effects of a cremated decedent, comprising:

(a.) a rectangular flat top and a flat base of equal size constructed of rigid material held apart by two shorter rectangular side walls of similar width separating said flat top and flat base; said flat top and flat base connected at all corners at right angles to said side walls, and a backing panel affixed to edges of said flat top, flat base, and side walls to form a structure with a recessed area on one side for housing said cremation urns, containers, and personal effects;

(b.) one or more additional walls of rigid material connected to said flat top, flat base, and backing panel to separate said recessed area into chamber areas within said recessed area for housing said cremation urns, containers, and personal effects;

(c.) illumination devices at predetermined areas on said flat base, flat top, side walls, or backing panel for providing illumination within said structure;

(d.) an opening or hole in said flat base or backing panel for inserting an electrical power supply for providing electricity;

(e.) decorative material affixed to wall surfaces of said chamber areas and a forward facing surface area of said backing panel;

(f.) at least one door constructed of rigid material attached to one of said side walls or said one or more additional side walls with one or more hinges and fasteners for allowing said door to open to expose said chamber areas;

(g.) an electronic imaging device or liquid crystal display screen with means to display electronic video, picture images, and means to produce sound; said electronic imaging device or liquid crystal display screen attached to or integrated within a removed area of material of said door so that said electronic imaging device or liquid crystal display screen is viewable from a front facing side of said structure when said door is in a closed position; and (h.) a plaque with writing or engraving attached to said door adjacent to said electronic imaging device or liquid crystal display screen.

2. The decorative device of claim 1, wherein the underside of said flat top has a removed area of material for allowing said illumination devices to be recessed and hidden within said flat top for illuminating said cremation urns from above within said structure.

3. The decorative device of claim 1, wherein a false wall constructed of a piece of rigid material abuts said flat top, flat base, and side walls behind said door for concealing wires, plugs, transformers, and other electronic devices from view behind said false wall.

4. The decorative device of claim 3, wherein lighting switches and/or emblems are affixed to the forward facing side of said false wall so that said lighting switches and/or emblems are visible when said door is in an opened position.

5. A decorative device for displaying cremation urns, containers housing the cremated remains of humans or animals, and personal effects of a cremated decedent, comprising:

(a.) a rectangular flat top and a flat base of equal size constructed of rigid material with recessed grooves on one side of each of said flat top and flat base; said flat top and flat base held apart by four elongated support members of a predetermined length; each support member inserted within a respective one of said recessed grooves; two rectangular side walls; one of each side walls inserted into recessed grooves of a respective pair of said support members; each of said side walls having a similar width to said flat top and flat base, and similar length to said support members; said flat top and flat base connected at all corners at right angles to said side walls and said support members, and a backing panel affixed to edges of said flat top, flat base, side walls and support members to form a structure with a recessed area on one side for housing said cremation urns, containers, and personal effects;

(b.) two interior separating walls constructed of rigid material interconnected through recessed grooves to said flat top, flat base, and backing panel to separate said recessed area into three chamber areas within said recessed area for housing said cremation urns, containers, and personal effects;

(c.) illumination devices recessed within grooves at predetermined areas of said flat top for providing illumination within said structure;

(d.) an opening or hole in said flat base or backing panel for inserting an electrical power supply for providing electricity;

(e.) decorative material affixed to wall surfaces of said chamber areas and a forward facing surface area of said backing panel;

(f.) at least one door constructed of rigid material attached to a front facing elongated support member with one or more hinges and fasteners for allowing said door to open to expose said chamber areas;

(g.) an electronic imaging device or liquid crystal display screen with integrated media storage and playback functions; said electronic imaging device or liquid crystal display screen attached to or integrated within a removed area of material of said door so that said electronic imaging device or liquid crystal display screen is viewable from a front facing side of said structure when said door is in a closed position;

(h.) a catch on said door for stopping the closing motion of said door in a predetermined flush position with a forward face of said structure; and (i.) a plaque with writing or engraving attached to said door adjacent to said electronic imaging device or liquid crystal display screen.

6. The decorative device of claim 5, wherein a false wall constructed of a piece of rigid material interconnects said flat top and flat base, and abuts said separating walls behind said door for concealing wires, plugs, transformers, and other electronic devices from view behind said false wall.

7. The decorative device of claim 6, wherein lighting switches and/or emblems are affixed to the forward facing side of said false wall so that said lighting switches and/or emblems are visible when said door is in an opened position.

* * * * *